US007207592B2

(12) United States Patent
Pascal et al.

(10) Patent No.: US 7,207,592 B2
(45) Date of Patent: Apr. 24, 2007

(54) BINDING FOR A SPORTS BOOT ON A GLIDING BOARD

(75) Inventors: Jean-Marc Pascal, Voreppe (FR); Hervé Cardeau, Tullins (FR)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 11/166,571

(22) Filed: Jun. 24, 2005

(65) Prior Publication Data

US 2006/0027981 A1 Feb. 9, 2006

(30) Foreign Application Priority Data

Jul. 1, 2004 (FR) ..... 04 07299

(51) Int. Cl.
*A63C 9/10* (2006.01)

(52) U.S. Cl. ..... 280/623; 280/619; 280/626; 280/621; 280/14.24

(58) Field of Classification Search ..... 280/613, 280/619, 611, 618, 626, 617, 627, 621, 628, 280/11.36, 629, 633, 634, 636, 14.21, 14.22, 280/14.24, 623, 607
See application file for complete search history.

(56) References Cited

U.S. PATENT DOCUMENTS 5,556,123 A * 9/1996 Fournier ..... 280/607
5,692,765 A * 12/1997 Laughlin ..... 280/619
5,918,897 A * 7/1999 Hansen et al. ..... 280/611
5,997,027 A * 12/1999 Jungkind ..... 280/617
6,003,893 A * 12/1999 Hansen ..... 280/624
6,007,077 A 12/1999 Moe
6,065,770 A * 5/2000 Hansen et al. ..... 280/617
6,116,634 A 9/2000 Mometti
6,464,237 B1 * 10/2002 Gracie ..... 280/14.24
6,676,152 B2 * 1/2004 Gonthier ..... 280/623
6,709,003 B2 * 3/2004 Laughlin et al. ..... 280/623
6,955,362 B2 * 10/2005 Bazzi ..... 280/14.22
7,048,295 B2 * 5/2006 Davies et al. ..... 280/623
2004/0075246 A1 * 4/2004 Davies et al. ..... 280/623
2004/0164521 A1 * 8/2004 Sato ..... 280/623
2004/0169350 A1 * 9/2004 Elkington ..... 280/623
2004/0262887 A1 * 12/2004 Bazzi ..... 280/617
2005/0046150 A1 * 3/2005 Couderc ..... 280/623
2005/0057009 A1 * 3/2005 Couderc ..... 280/11.36
2005/0161911 A1 * 7/2005 Piva ..... 280/623
2005/0285372 A1 * 12/2005 Edmond ..... 280/617

FOREIGN PATENT DOCUMENTS

AT 403 249 B 12/1997

(Continued)

*Primary Examiner*—J. Allen Shriver
(74) *Attorney, Agent, or Firm*—Frommer Lawrence & Haug LLP; Ronald R. Santucci

(57) ABSTRACT

A binding for a sports boot on a gliding board, comprising a base intended to be fixed on a gliding board, means for binding the boot and a rear stop or spoiler, wherein, on each lateral part of the base (1), the spoiler (3) is on the one hand mounted so as to move about a pin (4) mounted so as to move relative to the base (1) and on the other hand connected to the base (1) by a second means for guiding its movement relative to the base (1).

10 Claims, 9 Drawing Sheets

FOREIGN PATENT DOCUMENTS

| | | | | |
|---|---|---|---|---|
| EP | 0 705 625 | A | | 4/1996 |
| EP | 0 890 376 | A | | 1/1999 |
| EP | 0 908 206 | A | | 4/1999 |
| FR | 2 720 655 | A | | 12/1995 |
| FR | 2 758 469 | A | | 7/1998 |
| FR | 2 760 373 | A | | 9/1998 |
| JP | 2005-13725 | | * | 1/2005 |
| WO | WO 97/38764 | | | 10/1997 |

* cited by examiner

BINDING FOR A SPORTS BOOT ON A GLIDING BOARD

This application claims priority benefits from French Patent Application No. 04 07299 filed Jul. 1, 2004.

BACKGROUND OF THE INVENTION

The invention relates to a binding for a sports boot on a gliding board, comprising a base capable of being fixed on a gliding board, binding means such as jaws or straps for binding a sports boot and a rear stop referred to as a "spoiler", whose function is to hold the rear of a boot.

DESCRIPTION OF THE PRIOR ART

A snowboard binding of the prior art is described in Document FR2758469. It comprises two wings fixed on a base of the binding. The spoiler is articulated so as to rotate on these wings. In order to engage the binding, the user unlatches a latching hoop and turns the spoiler rearward in order to free a space allowing them to put their boot through. When the boot is correctly positioned, it is finally fixed by straps on the instep and by the spoiler, replaced in the rear stop position. The advantage of such a solution is that it allows engagement and release of the boot facilitated by rotating the spoiler rearward with a very simple mechanism. This solution may prove unsatisfactory in certain cases, however, for example when the instep binding mechanism represents an encumbrance which impedes engagement/release of the boot.

Document EP 0705625 likewise relates to a solution which the spoiler is mounted so as to rotate on the base in order to facilitate engagement. This solution has the same drawbacks as the previous one.

In order to overcome these drawbacks, a solution described in Document FR2720655 relates to a snowboard binding whose spoiler is mounted so as to rotate on the base and whose instep holding means is mounted so as to move on the spoiler. During the engagement and release operations, the spoiler and the instep holding means thus move apart, respectively rearward and forward, in order to free a larger space for positioning the boot. The movement of the instep holding means, however, has a relatively small amplitude in this solution and the progress is far from sufficient.

Other solutions, described in Documents AT403249, EP0908206 and U.S. Pat. No. 6,116,634, proposed a spoiler which can rotate on the base of a snowboard binding and is connected to an instep binding means via a connecting bar, in order to cause a larger-amplitude movement of the instep binding means when the spoiler turns rearward. These solutions use complex mechanical elements which occupy a large lateral and/or vertical space around the walls of the base, and this increases the encumbrance of the bindings and weakens them because these mechanical elements can be struck and damaged by the boot during the engagement and release phases. These solutions are furthermore expensive owing to their complexity.

It is therefore a general object of the present invention to provide a boot binding on a gliding board which facilitates the engagement and release operations, without having the drawbacks of the prior art.

More precisely, it is a first object of the invention to provide a boot binding on a gliding board which effectively facilitates the engagement and release operations.

It is a second object of the present invention to provide a boot binding on a gliding board which facilitates engagement and release, which is simple and economical and has a small encumbrance beyond the base of the binding.

SUMMARY OF THE INVENTION

The invention is based on a binding for a sports boot on a gliding board, comprising a base intended to be fixed on a gliding board, means for binding the boot and a rear stop or spoiler, this spoiler being, on each lateral part of the base, on the one hand mounted so as to move about a pin mounted so as to move relative to the base and on the other hand connected to the base by a second means for guiding its movement relative to the base The second means connecting the spoiler to the base may be a retaining cord.

According to a first variant, the pin may be mounted on a connecting bar mounted so as to move on the base.

According to a second variant, the connecting bar may be mounted so as to rotate about a pin on the base.

At least one means for binding the boot may be mounted so as to move relative to the base, its movement being linked with that of the pin. To this end, it may be mounted directly on this pin, or it may be mounted on another pin which is mechanically connected to this pin and which may also be mounted on a connecting bar or in a slot of the base.

The binding of the invention may furthermore have a locking/unlocking device, which may for example consist of a locking element which acts on a cam-shaped profile of the connecting bar. As a variant, the locking element may be of the toggle type.

The binding according to the invention may have a pedal mechanically coupled to the pin on which the spoiler is mounted, so as to make it move automatically to engage or release a boot in the binding.

According to a variant, the pedal may be mechanically coupled to the connecting bars on which the pin is mounted, so as to make the connecting bars rotate automatically to engage the binding.

To this end, the connecting bars and the pedal may be mounted so as to rotate about the same pin relative to the base, the pedal comprising a protuberance placed in a slot of each connecting bar in order to move it automatically, the spoiler being moveable about a pin mounted on each connecting bar.

The lateral parts of the base may have an extra thickness in order to conceal the connecting bars within the walls of the base.

DESCRIPTION OF THE DRAWINGS

These objects, features and advantages of the present invention will be explained in detail in the following description of a particular embodiment, provided without implying limitation and with reference to the appended figures, in which.

DESCRIPTION OF THE PREFERRED EMBODIMENTS

Figure 1:
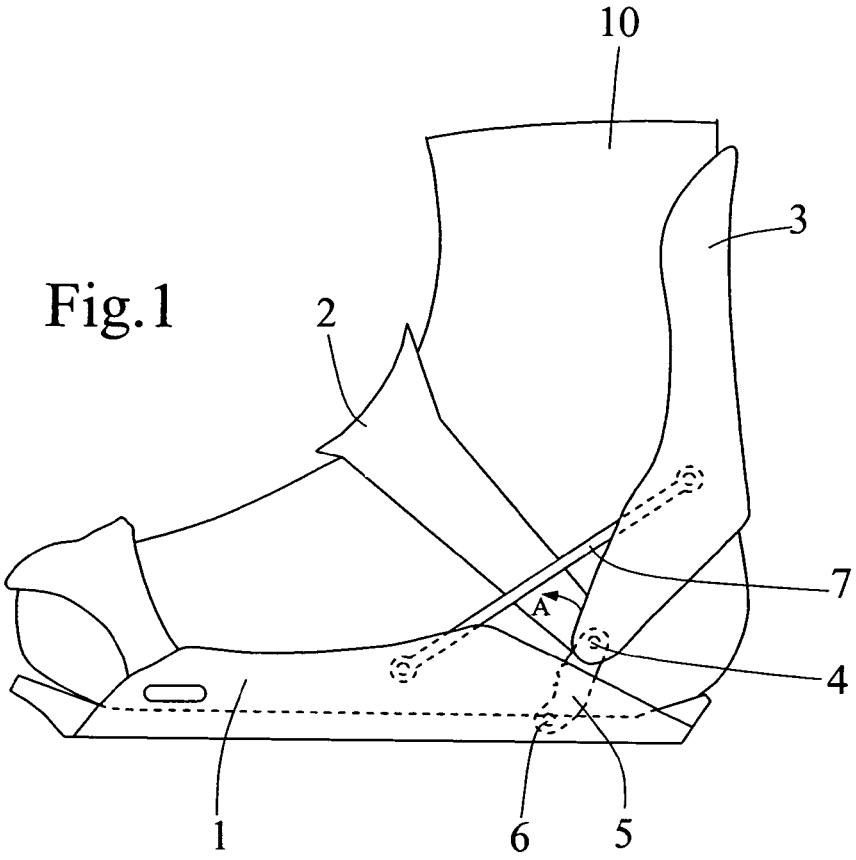
FIG. 1 represents a first embodiment of a binding according to the invention in the closed position.

According to a first embodiment the device for binding a boot 10, represented in the closed position in FIG. 1, comprises a base 1 fixed on a gliding board (not shown), means 2 for holding the instep and a spoiler 3. The base 1 comprises two lateral parts on which the spoiler 3 is mounted so as to rotate about a pin 4 mounted on a connecting bar 5, which is mounted so as to rotate about a pin 6 on the base 1. Furthermore, the spoiler 3 is also connected directly to each lateral part of the base 1 by a retaining cord 7. The instep holding means consists of two straps, front and rear, the rear strap 2 also being mounted on the connecting bar 5 level with the pin 4. The figures show only one lateral part of the binding, but all these means are duplicated symmetrically on the second lateral part of the base, which cannot be seen. The retaining cord 7 fulfils a rear stop function for the spoiler 3 when the binding is in this closed position, since it holds the spoiler against the rear of the boot, preventing it from moving away from the latter.

Figure 2:
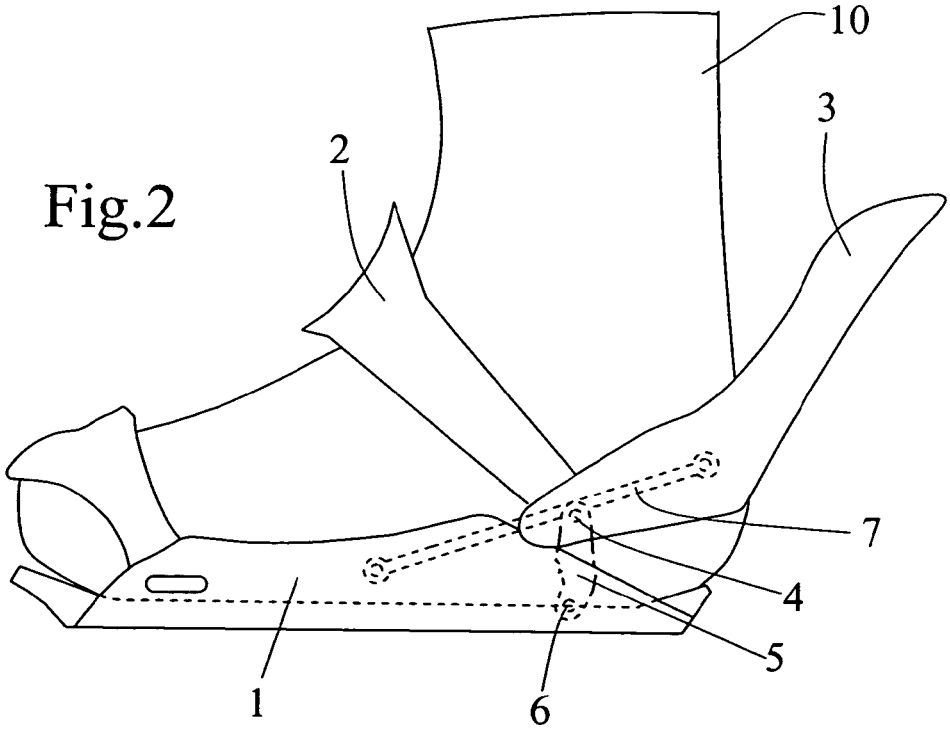
FIG. 2 represents the first embodiment of the binding according to the invention in an intermediate situation with the spoiler pivoting rearward.
Figure 3:
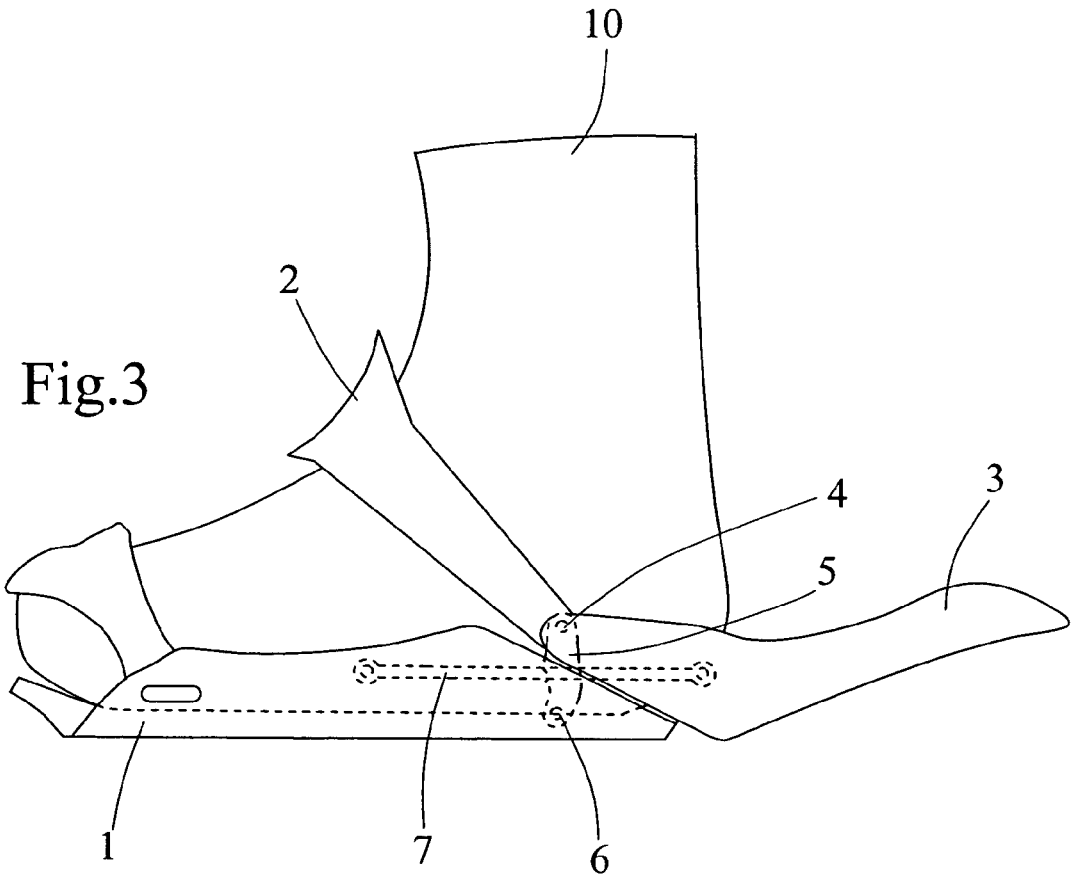
FIG. 3 represents the first embodiment of the binding according to the invention in a situation in which the spoiler has fully pivoted rearward.

This device facilitates engagement/release since it makes it possible to free a large space for positioning or removing the boot. As represented in FIGS. 2 and 3, the connecting bar 5 can be turned in the direction of the arrow A about the pin 6 vis-à-vis the base 1. This rotation of the connecting bar automatically makes the spoiler 3 rotate rearward about the pin 4, under the effect of the retaining cord. At the same time, the rear instep holding means 2 is moved toward the front of the binding. As represented in FIG. 3, the spoiler 3 continues to rotate until it rests on the gliding board. The bottom part of the spoiler has a notched shape in order to accommodate the rear of the boot in this rearward rotational movement.

During engagement and release, the function of the retaining cord is therefore to guide the spoiler when the connecting bar is turned. To this end, the retaining cord 7 has a fairly high stiffness because its length must remain substantially constant in spite of the forces experienced. Nevertheless, it will be advantageous to provide it with lateral flexibility so that it can move away slightly under the effect of possible impacts with the boot during the engagement/release operations. To this end, it may be a metal cable or a plastic band, optionally reinforced with fibers. Furthermore, it will not be fixed too close to the connecting bar in order to have a significant guiding effect and an efficient stop function for the spoiler. In this embodiment, it is thus fixed toward the central part of the lateral part of the base (1).

Figure 4:
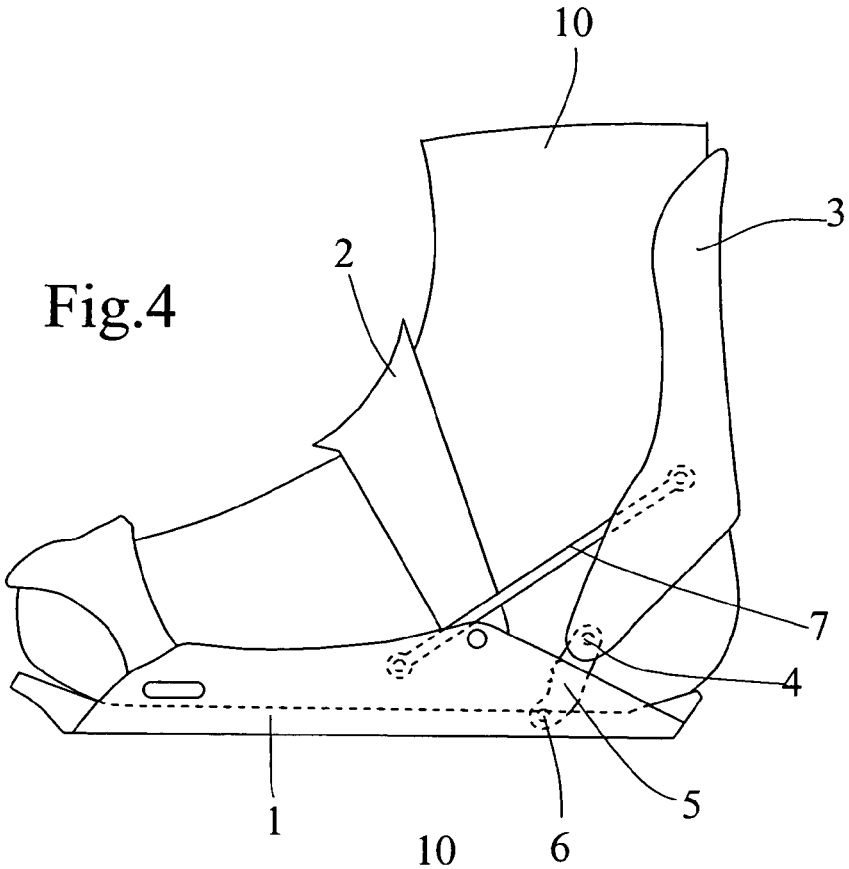
FIG. 4 represents a variant of the first embodiment of the binding according to the invention in the closed position.
Figure 5:
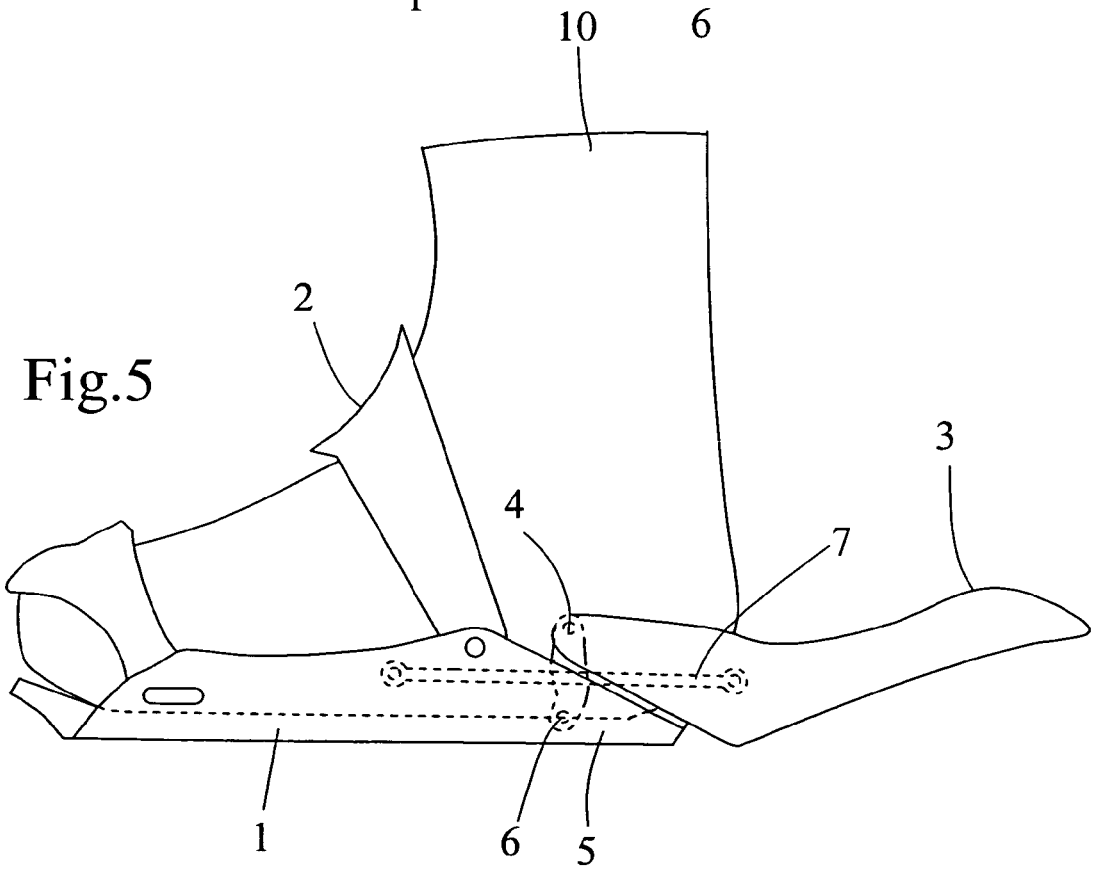
FIG. 5 represents the variant of the first embodiment of the binding according to the invention in the fully open position.

FIGS. 4 and 5 represent an alternative embodiment of the binding device of the first embodiment in FIGS. 1 to 3, in the closed and open positions. In this variant, the means for holding the instep of the boot are simpler and more economical, positioned further forward and connected directly to the base of the binding. The spoiler is still connected on each of the lateral parts of the base via a connecting bar 5, on the one hand, and via a retaining cord 7 on the other hand. This solution offers clearance for the spoiler equivalent to the solutions in the prior art, in which the spoiler is mounted so as to rotate directly on the base. It has the additional advantage of providing flexibility and economies for manufacture of the bindings, since the same elements for fixing the spoiler on the base are used in this variant as in the solution described above.

Summarizing the two variants of this first embodiment of the invention, the concept of this invention consists in providing, on each lateral part of the base, on the one hand a first connection of the spoiler 3 to the base 1 with a twofold degree of freedom, for example double rotation, via a connecting bar 5, and on the other hand in providing a second connection of the spoiler 3 to the base 1, for example by a retaining cord 7, the function of which is to guide the movement of the spoiler while reducing its degree of freedom to move vis-à-vis the base in order to impose a single possible movement on it, which is selected according to the intended advantages.

This concept, as implemented by the previous variants, makes it possible to obtain a device having the following advantages:

- it allows the movement of the spoiler to be linked very simply to the movement of other elements of the binding, if necessary, in order to free a large space to facilitate the engagement/release operations;
- it also allows significant clearance for the spoiler;
- it is simple and represents a small lateral and vertical encumbrance, and does not therefore have the weakness defects of the prior art;
- it allows flexibility and economies for manufacture of the bindings, since the same device for fastening the spoiler can readily be used for different configurations of the other elements of the binding.

Figure 6:
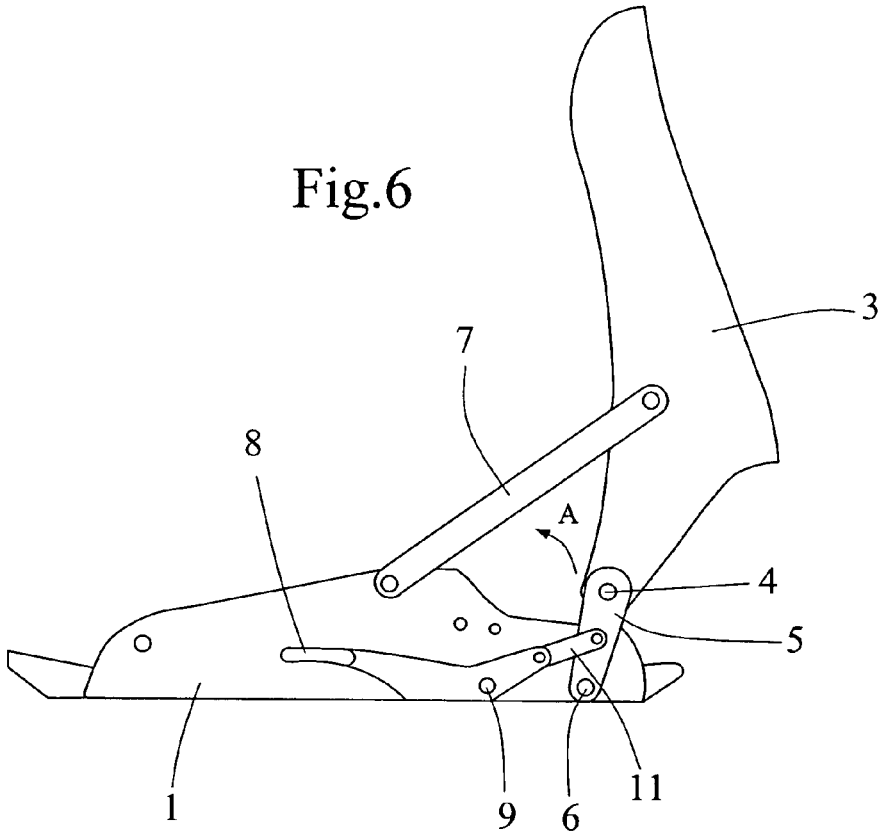
FIG. 6 represents a variant of the first embodiment of the binding according to the invention with a locking means in the closed position.
Figure 7:
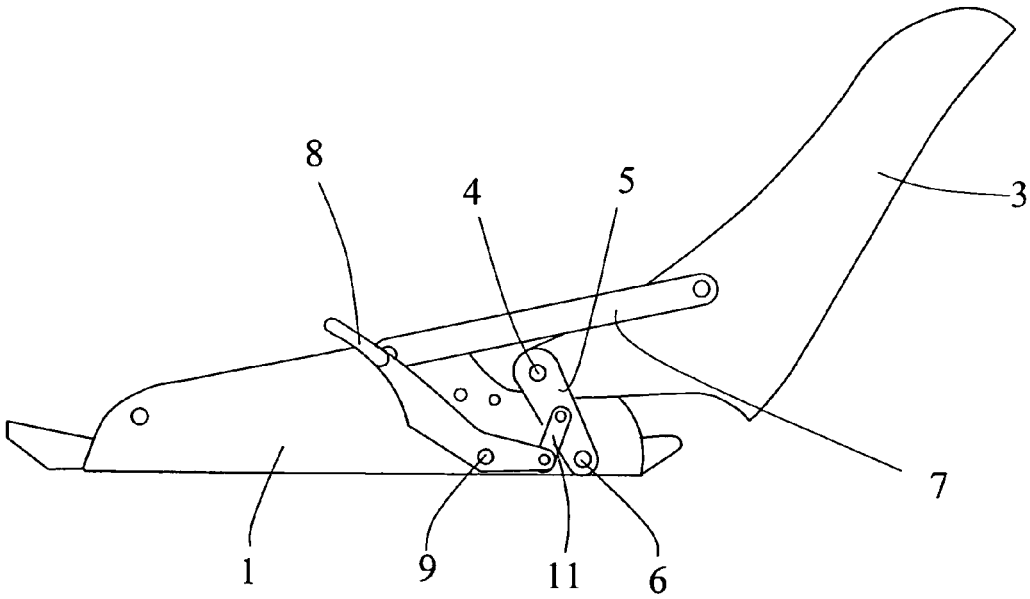
FIG. 7 represents a variant of the first embodiment of the binding according to the invention with a locking means in the open position.

FIGS. 6 and 7 illustrate a locking/unlocking device suitable for the alternative embodiments described above. It is composed of a lever 8, which is mounted so as to rotate about a pin 9 on the base 1 and is connected to the two connecting bars 5 by a mechanical linkage allowing them to be locked and unlocked by a toggle mechanism 11. This mechanism allows the connecting bar to be locked in a closed position, as illustrated in FIG. 6, corresponding to the raised position of the spoiler in order to fulfill its rear stop function. It also makes it possible to free the movement of the connecting bar 5 by simply actuating the lever 8, as illustrated in FIG. 7.

Figure 8:
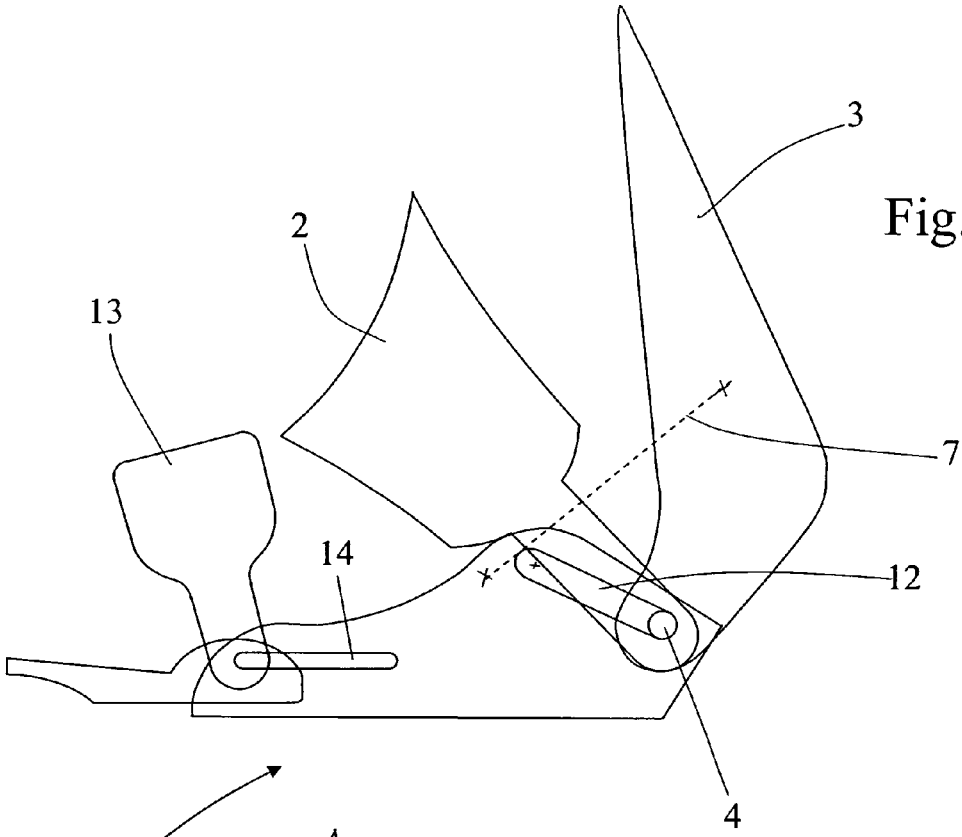
FIG. 8 represents a second embodiment of a binding according to the invention in the closed position.

FIG. 8 illustrates a binding device in the closed position according to a second embodiment of the invention. The spoiler 3 is connected to each lateral part of the base by a rotation pin 4 which can move in a slot 12 of the base. It is furthermore connected to the base by a retaining cord 7, as in the first embodiment. The instep holding means are composed of a rear strap 2, also mounted on the pin 4, and a front holding means 13 mounted so as to move on the base 1 via a slot 14, so that this front means 13 can be adjusted to the size of the boot.

Figure 9:
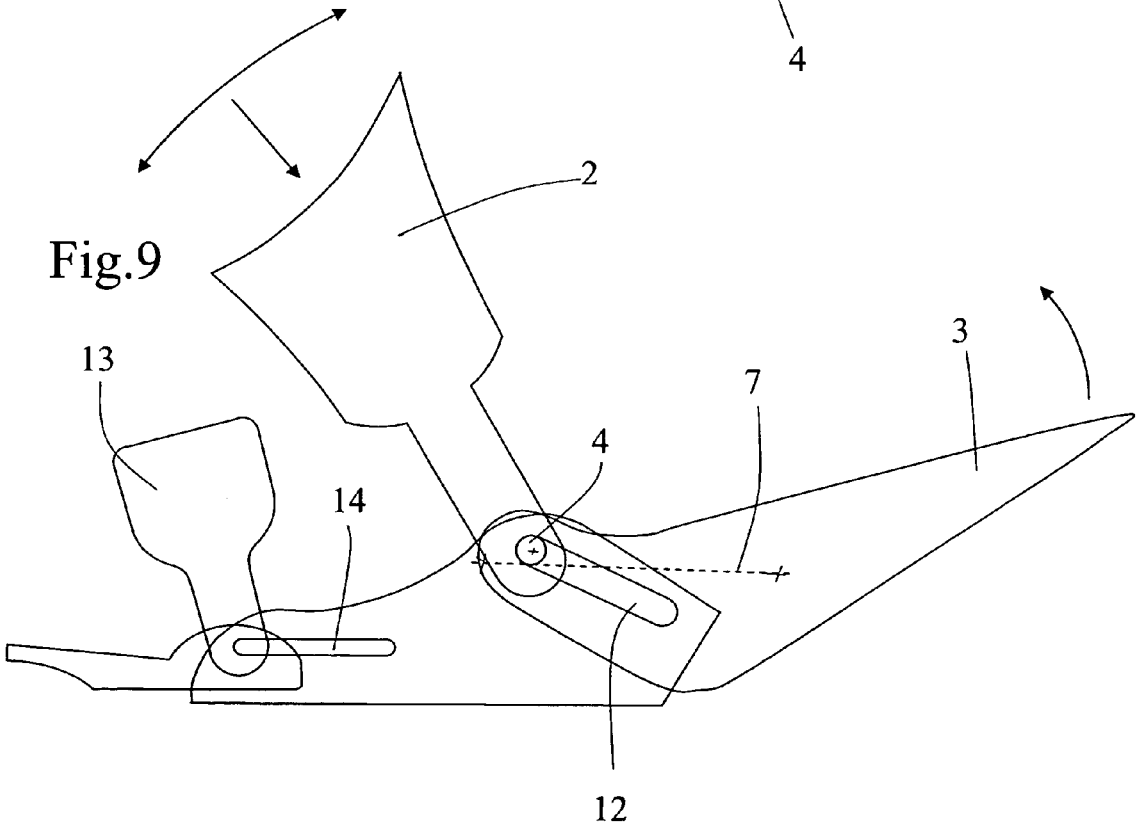
FIG. 9 represents the second embodiment of the binding according to the invention in a situation in which the spoiler has fully pivoted rearward.

FIG. 9 illustrates this device in the fully open position. The pin 4 is moved toward the front end of the slot 12, and thus occupies a position further forward and further upward. The means 2 for retaining the instep therefore also occupies a position which is further forward and raised, thus freeing a space for a boot to be put through. This space is easy to parameterize since it depends directly on the length and shape of the slot 12. At the same time, the spoiler 3 has been placed in a position resting on the rear of the binding in response to the rotation about the pin 4, under the pressure of the retaining cord 7 when the pin 4 is moved, thus also making it possible to free a space for a boot to be put through the rear of the binding. This embodiment therefore makes it possible to free a large space at the rear of the binding by a simultaneous large-amplitude movement of the spoiler 3 and the instep retaining means 2.

Figure 10:
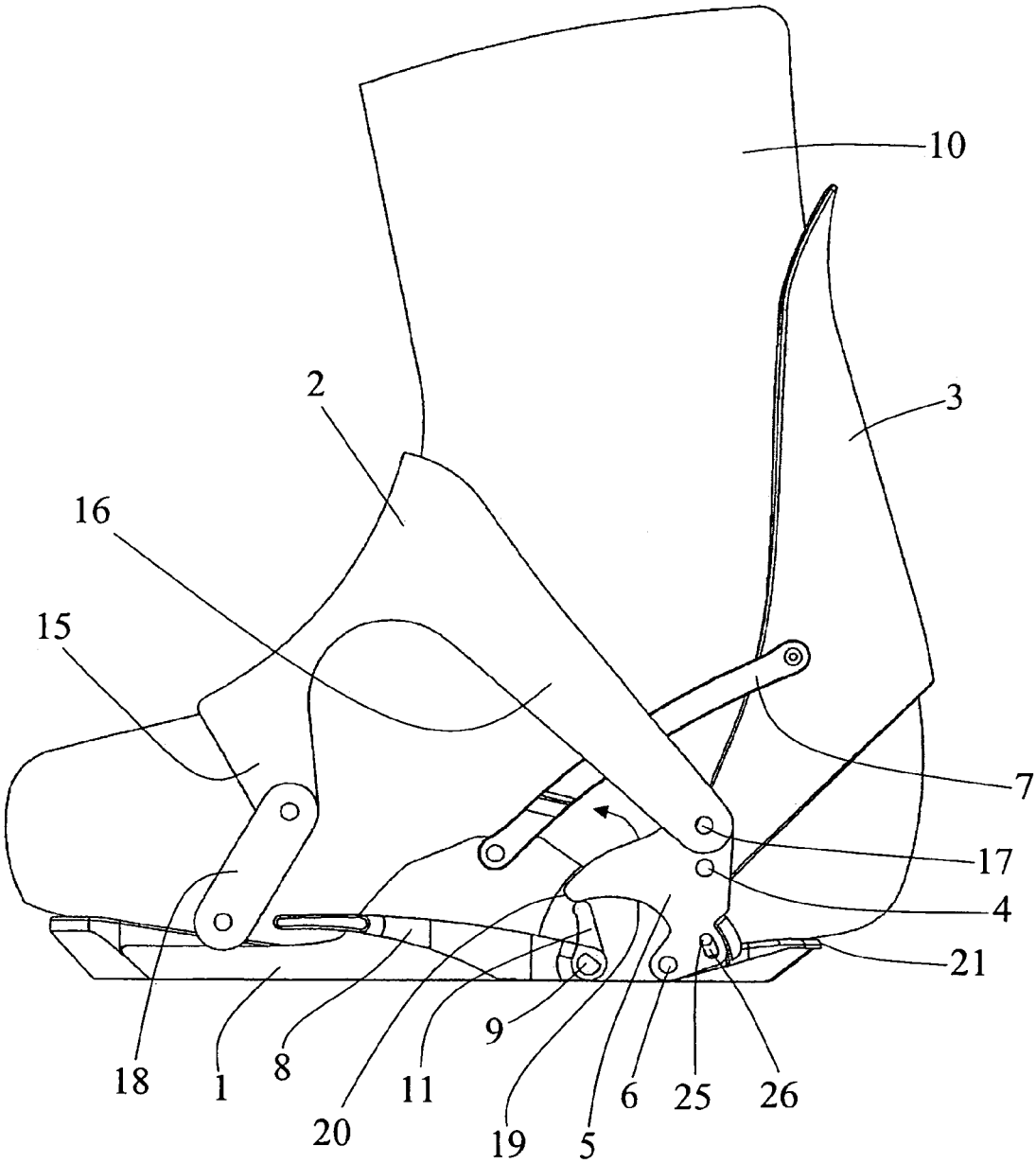
FIG. 10 represents a third embodiment of a binding according to the invention in the closed position.

A third embodiment is represented in FIGS. 10 to 13. FIG. 10 shows this device in the closed position, i.e. holding a boot 10 at the rear by the maximally raised spoiler 3 and on the top of the foot by the holding means 2. The spoiler 3 is mounted so as to rotate about a pin 4 on a connecting bar 5, which is itself mounted so as to rotate on each lateral part of the base 1 about a pin 6. For the sake of simplicity, a single lateral part of the base 1 is illustrated, the second lateral part being symmetrically identical. A retaining cord 7 connects the spoiler 3 to the base 1. The means 2 for holding the top of the foot has two arms, front 15 and rear 16. The rear arm 16 is mounted so as to rotate on the connecting bar 5 about a pin 17, and the front arm is connected to the base via a front connecting bar 18 providing the freedom necessary to move the element 2. This device also has a locking means consisting of a lever 8 mounted so as to rotate on the base 1 about a pin 9, and of a locking element 11 which connects the lever 8 and a particular cam surface 19 of the connecting bar 5. The element 11 can rotate relative to the base 1 about the pin 9, its movement being integral with that of the lever 8. The cam surface 19 is such that the connecting bar 5 is locked by the element 11 when the lever 8 is in the bottom position.

Figure 11:
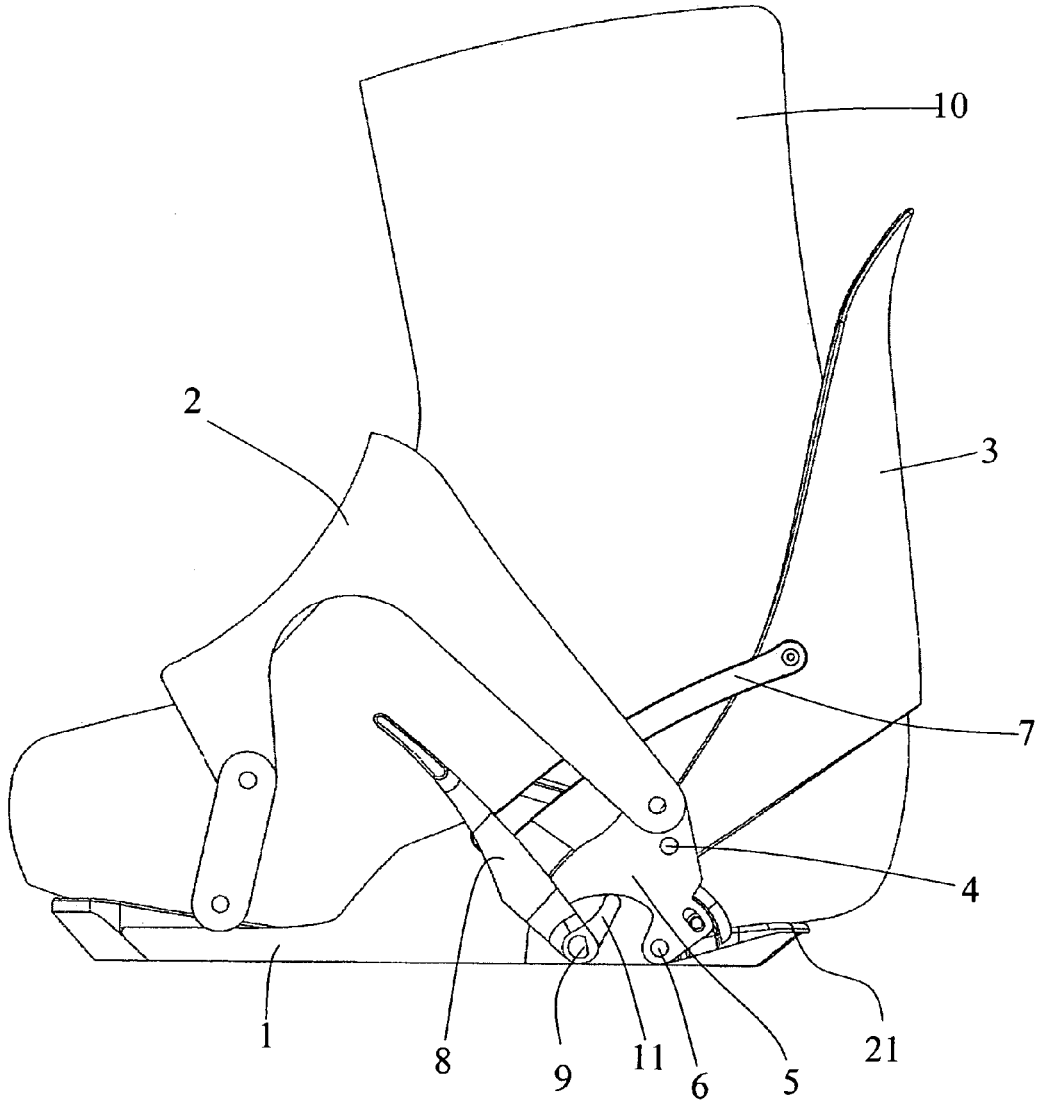
FIG. 11 represents the third embodiment of the binding according to the invention in an intermediate situation with the spoiler pivoting rearward.
Figure 12:
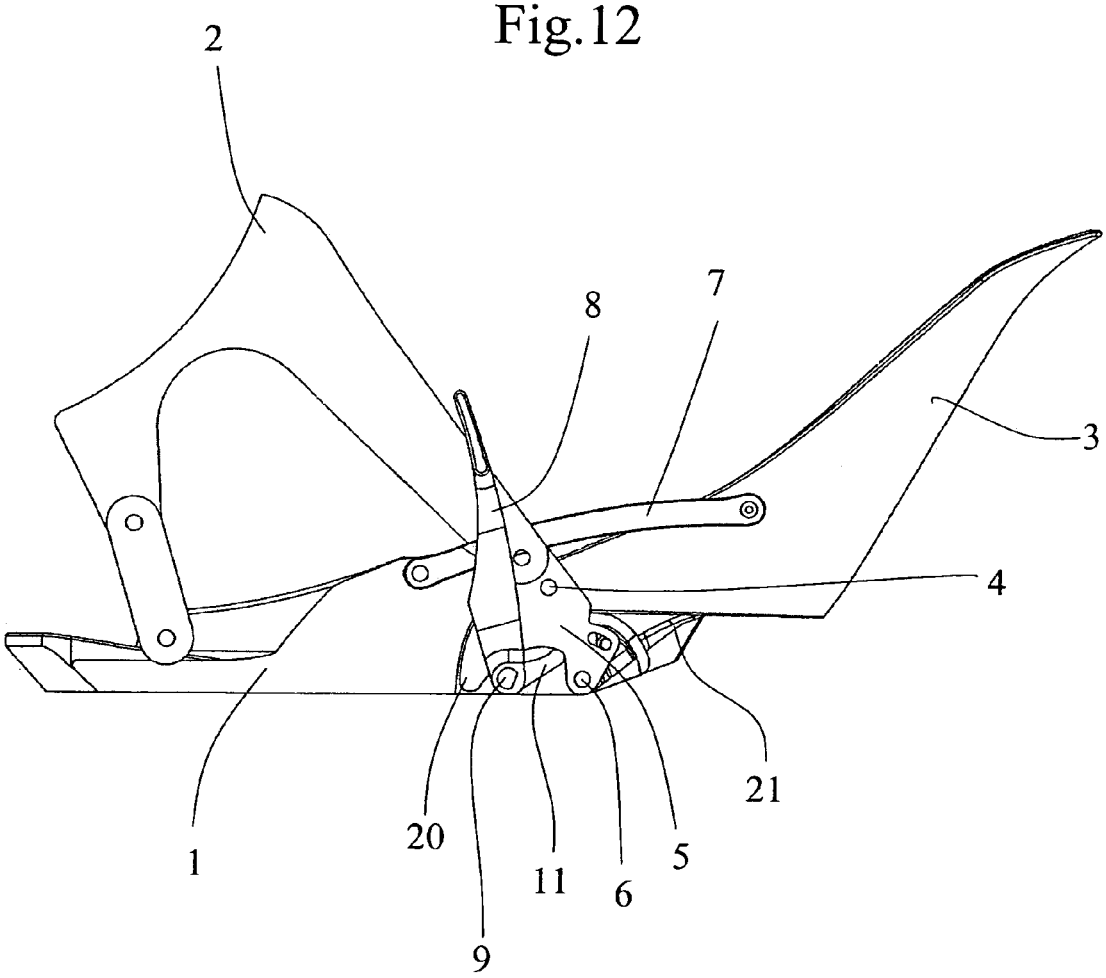
FIG. 12 represents the third embodiment of the binding according to the invention in a situation in which the spoiler has fully pivoted rearward.

For a release operation, the lever 8 is raised, which frees the locking of the connecting bar by the locking element 11. By raising the boot, the spoiler can then be tilted manually rearward or, according to a more automatic solution, a return spring (not shown) may rotate the connecting bar in the direction of the arrow A. FIG. 11 represents an intermediate position of the binding, and FIG. 12 represents the binding in the fully open position, in which the lever 8 is fully raised, with the connecting bar 5 having finished its rotation and its part 20 at the end of the cam surface 19 abutting against the base 1 of the binding. The spoiler occupies its extreme resting position and the element 2 is raised and pushed forward. The connecting bar 18 has been rotated in the direction of the arrow A in response to the rotation of the connecting bar 5, in order to permit and accompany its movement.

Figure 13:
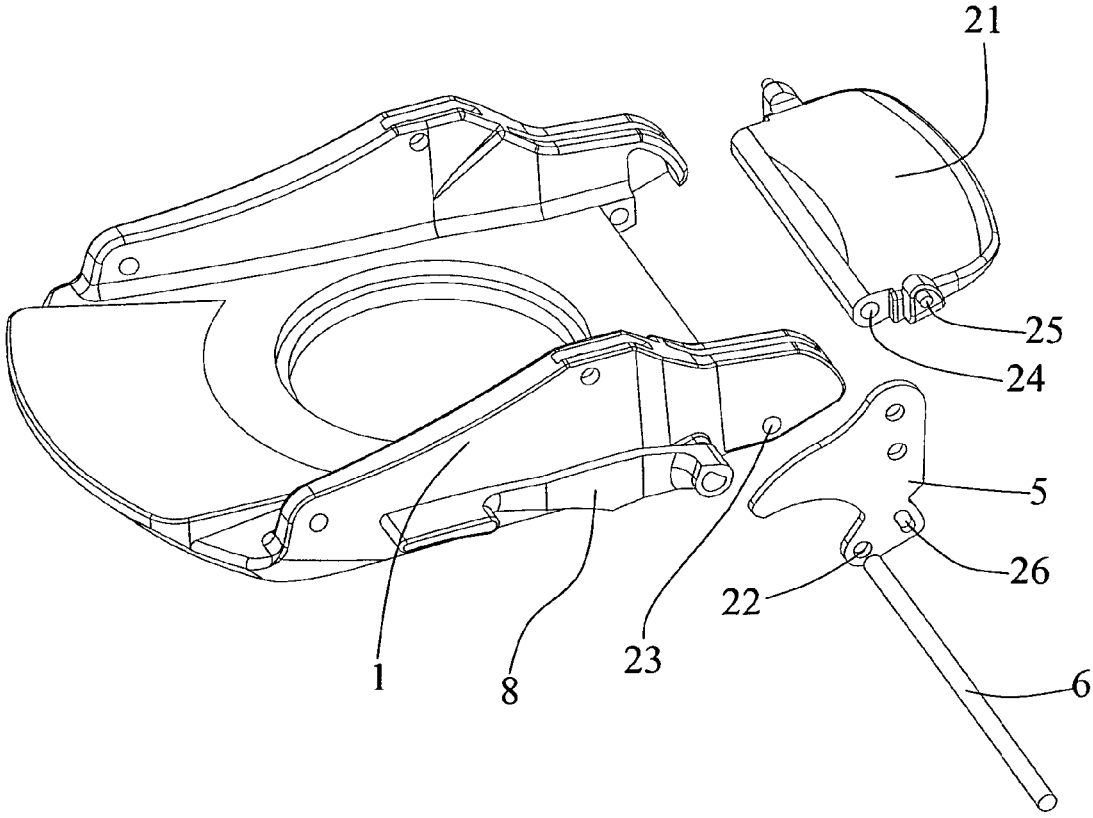
FIG. 13 represents a plan view of the third embodiment of the invention.

This device also has a pedal 21, the function of which is to make the closure and opening of the binding quasi-automatic. Specifically, the pedal 21 is moved under the effect of a boot 10 positioned in the binding, and has a linkage with the connecting bar 5 so that the movement of the elements is linked. As represented in FIG. 13, each connecting bar 5, the base 1 and the pedal 21 respectively have openings 22, 23 and 24 to allow passage of a pin 6 for rotary mounting of the pedal and the connecting bars about the same pin 6 on the base. The pedal furthermore comprises a protuberance 25 corresponding to a slot 26 of each connecting bar, so that the rotation of the pedal 21 in response to the heel pressure of a boot during an engagement operation makes the connecting bars rotate in the direction counter to A, which tightens the element 2 and the spoiler 3 on the boot 10. At the end of the movement, the locking in the closed position is completed by actuating the lever 8 in a final position parallel to the board, resting perfectly on the base 1.

The device as illustrated by this last embodiment has an additional advantage of being particularly suitable for installing a simple quasi-automatic mechanism for simultaneously moving a plurality of elements of the binding, including the spoiler, to free a large space in response to the insertion or removal of a boot in the binding.

The lateral and vertical encumbrance of the elements of the solution is moderate, and it would even be possible to conceal some of these elements, especially the connecting bar, in a location provided within the thickness of the base so as to protect them against possible impacts while obtaining a more aesthetic effect.

The invention claimed is:

1. A binding for a sports boot on a gliding board, comprising:

a base (1) fixed on a gliding board;

means (2) for binding the boot; and a rear stop or spoiler (3), wherein on each lateral part of the base (1), the spoiler (3) is mounted to move about a pin (4);

second means connecting the spoiler (3) to the base (1), wherein the pin (4) is mounted to move relative to the base (1) and the second means guides the movement of the pin (4) relative to the base (1), and wherein the second means connecting the spoiler (3) to the base (1) is a retaining cord (7).

2. The binding for a sports boot on a gliding board as claimed in claim 1, wherein the pin (4) is mounted on a connecting bar (5) mounted so as to move on the base (1).

3. The binding for a sports boot on a gliding board as claimed in claim 2, wherein the connecting bar (5) is mounted so as to rotate about a pin (6) on the base (1).

4. The binding for a sports boot on a gliding board as claimed in claim 1, wherein at least one means (2) for binding the boot is mounted to move relative to the base (1), movement of the at least one means being linked with that of the pin (4).

5. The binding for a sports boot on a gliding board as claimed in claim 4, wherein the at least one means (2) is mounted to move on a pin (17) coinciding with the pin (4).

6. The binding for a sports boot on a gliding board as claimed in claim 4, wherein the at least one means (2) is mounted so as to move on a pin (17) which is separate from the pin (4) but is connected to the pin (4) so that the movement of the pin (4) relative to the base (7) causes the pin (17) to move relative to the base (1).

7. The binding for a sports boot on a gliding board as claimed in claim 2, which has a pedal (21) mechanically coupled to the pin (4) so as to make the spoiler (3) move automatically to engage or release a boot (10) in the binding.

8. The binding for a sports boot on a gliding board as claimed in claim 7, wherein the pedal (21) is mechanically coupled to the connecting bar (5) on which the pin (4) is mounted, so as to make the connecting bar (5) rotate automatically to engage the binding.

9. The binding for a sports boot on a gliding board as claimed in claim 8, wherein the connecting bar (5) and the pedal (21) are mounted so as to rotate about the same pin (6) relative to the base (1), wherein the pedal (21) comprises a protuberance (25) placed in a slot (26) of the connecting bar (5) in order to move it automatically, and wherein the spoiler (3) can move about a pin (4) mounted on the connecting bar (5).

10. The binding for a sports boot on a gliding board as claimed in claim 2, wherein the lateral parts of the base (1) have an extra thickness in order to conceal the connecting bar (5) within the walls of the base.

* * * * *